US006374944B1

(12) United States Patent
Curl, Jr.

(10) Patent No.: US 6,374,944 B1
(45) Date of Patent: Apr. 23, 2002

(54) SILENCER WITH INTERNAL RAIN DIVERTER

(75) Inventor: Bruce Lawrence Curl, Jr., Jackson, MI (US)

(73) Assignee: Eaton Corporation, Cleveland, OH (US)

( * ) Notice: Subject to any disclaimer, the term of this patent is extended or adjusted under 35 U.S.C. 154(b) by 36 days.

(21) Appl. No.: 09/584,207

(22) Filed: May 31, 2000

(51) Int. Cl.[7] ..... F01N 7/18

(52) U.S. Cl. ..... 181/282; 181/222; 181/224; 181/255; 181/256; 181/264; 181/269

(58) Field of Search ..... 181/282, 255, 181/256, 258, 264, 269, 222, 224

(56) References Cited

U.S. PATENT DOCUMENTS

| | | | | | |
|---|---|---|---|---|---|
| 4,693,339 | A | * | 9/1987 | Beale et al. | 181/255 |
| 4,842,096 | A | * | 6/1989 | Fujitsubo | 181/252 |
| 5,444,197 | A | * | 8/1995 | Flugger | 181/264 |
| 5,808,245 | A | * | 9/1998 | Wiese et al. | 181/255 |

* cited by examiner

*Primary Examiner*—Shih-Yung Hsieh
(74) *Attorney, Agent, or Firm*—Loren H. Uthoff, Jr.

(57) ABSTRACT

Disclosed herein is a silencer for reducing acoustic energy in a flow of exhaust gas from a combustion power source which prevents rain or snow from entering an exhaust stack without the need for a weather cap or hood. The silencer achieves acoustic energy attenuation and precipitation diversion with a minimal increase in backpressure. The silencer comprises a chamber at least partially defined by a chamber wall in communication with an inlet port for introducing exhaust gas into the chamber and an exhaust port for exiting exhaust gases from the chamber. The inlet port may be in communication with an inlet collar for attachment to an exhaust stack. A housing at least partially surrounds the chamber wall to form at least one cavity between the chamber wall and the housing where acoustic absorbing material is disposed. A deflector is at least partially disposed within the chamber having a gallery portion in communication with the channel. The channel is provided for draining the contents of the gallery portion which are diverted from entering the exhaust stack. The deflector may be substantially V-shaped or have a substantial concave shape. For purposes of reducing backpressure, the deflector is substantially centered about a vertical axis of the exhaust port.

3 Claims, 2 Drawing Sheets

FIG 2
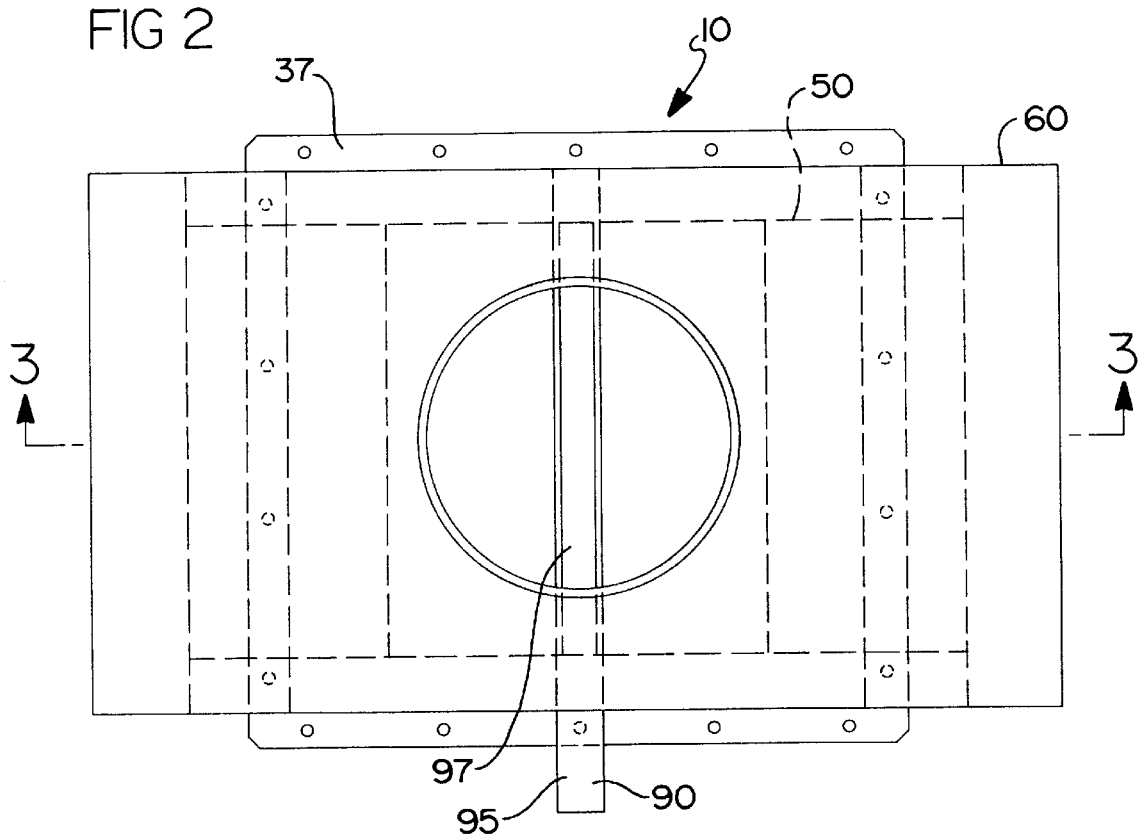
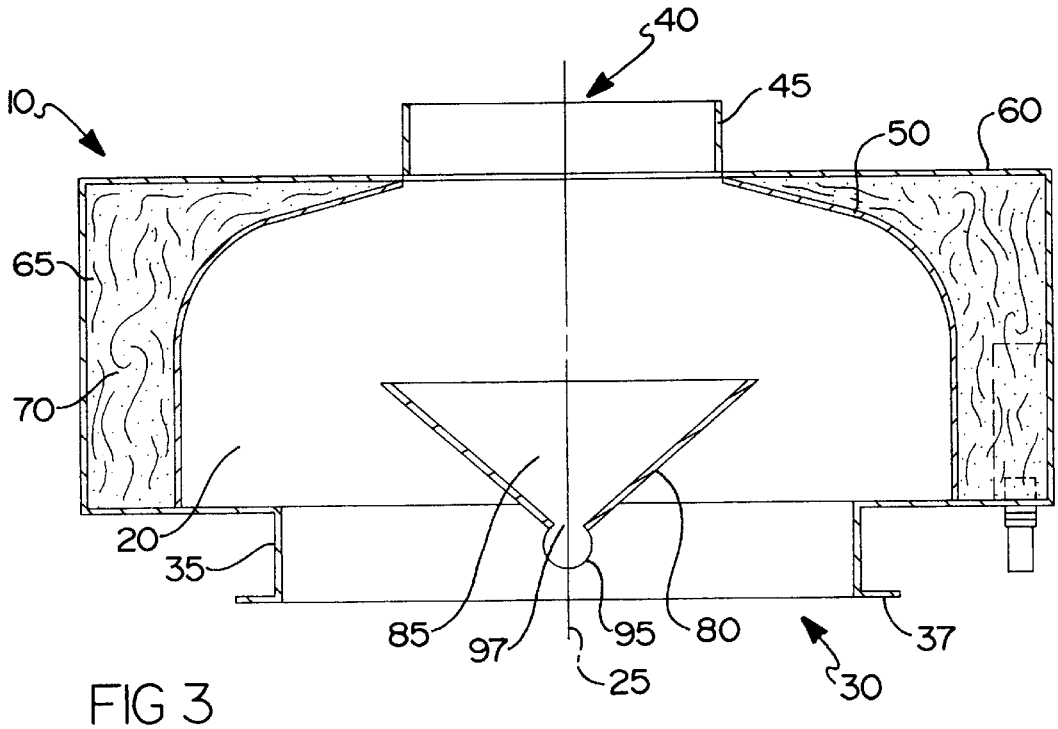
FIG 3

SILENCER WITH INTERNAL RAIN DIVERTER

RELATED APPLICATIONS

This application relates to patent application U.S. Ser. No. 09/1376,744, entitled "Turbo-Generator Exhaust Noise Silencer", filed on Aug. 17, 1999, and assigned to the same assignee, Aeroquip Corporation, as this application.

FIELD OF THE INVENTION

The present invention relates to sound attenuation devices such as silencers, and more specifically, to sound attenuation devices for use with turbo generators or other combustion power sources.

BACKGROUND OF THE INVENTION

Combustion power sources such as turbo generators, periodic internal combustion engines and microturbine generators for use with machinery, industrial equipment or for electric power production produce significant noise which travels through the combustion power source exhaust system. The noise emitted from combustion power sources can be undesirable and therefore must be attenuated. Therefore, the prior art is replete with a variety of silencers and other sound attenuation devices to reduce the audible noise level associated with combustion power sources.

Some mufflers or silencers use a series of tubes, baffles and chambers of varying shapes and sizes to alter the path of exhaust gases over a short distance. While such mufflers may be effective in reducing noise levels, they tend to create undesirable high backpressure on the power source, resulting in lower power output and lower efficiency. Other mufflers direct the exhaust gases straight through a perforated tube within a larger tube, with sound adsorbing material such as glass wool located between the two tubes. These so-called "glass-pack" mufflers produce low backpressure, but are not very effective in reducing noise levels.

Exhaust stacks for combustion power sources which include mufflers or silencers typically also include a rain hood or cap to prevent rain, snow or other contaminants from entering the combustion power source exhaust stack. Devices such as a rain hood or weather hood will add additional backpressure to the flow of exhaust gas from the combustion power source further reducing efficiency and power output. While these stacks which include a muffler or silencer along with a weather hood reduce noise, there remains a need for a silencer that achieves high engine efficiency with a minimum increase in backpressure while preventing unwanted contaminants from entering the exhaust stack. Furthermore, an integrated silencer and internal rain diverter will reduce cost and part complexity.

Therefore, there is a need in the art for an improved silencer which includes an integrated rain diverter.

SUMMARY OF THE INVENTION

Accordingly, it is a feature of the present invention to provide a silencer and rain diverter without providing additional backpressure on a combustion power source. More particularly, it is an object of the present invention to provide a silencer with an integrated rain diverter without significantly increasing backpressure or resistance to the exhaust flow.

Provided herein is a silencer for reducing acoustic energy in a flow of exhaust gas from a combustion power source. The silencer comprises a chamber which is at least partially defined by a chamber wall where the chamber is in communication with an inlet port for introducing exhaust gas in the chamber and an exhaust port for exiting exhaust gas from the chamber. The inlet port is adapted to be in communication with an exhaust stack leading from the combustion power source. A housing at least partially surrounds the chamber wall to form at least one cavity between the chamber wall and the housing. The cavity may have acoustic absorbing material provided therein to assist in sound attenuation. A deflector is at least partially disposed within the chamber which has a gallery portion in communication with a channel. The channel is provided for draining the contents of the gallery portion which have been diverted from entering the exhaust stack.

The chamber wall may have a plurality of perforations therein. Furthermore, an inlet collar may be provided in communication with the inlet port to permit the silencer to be attached to an exhaust stack. The deflector may be substantially V-shaped or may have a substantially concave shape. Furthermore, the channel may take the form of a tube. The channel may extend through the chamber wall, through the housing, or through the inlet sleeve.

Further objects, features and advantages of the present invention will become apparent to those skilled in the art from analysis of the following written description, the accompanying drawings and appended claims.

BRIEF DESCRIPTION OF THE DRAWINGS

FIG. 2 is a top view of a silencer with an internal diverter.

FIG. 3 is a sectional view of the silencer of FIG. 2 taken along line A—A.

DETAILED DESCRIPTION OF THE PREFERRED EMBODIMENT

Figure 1:
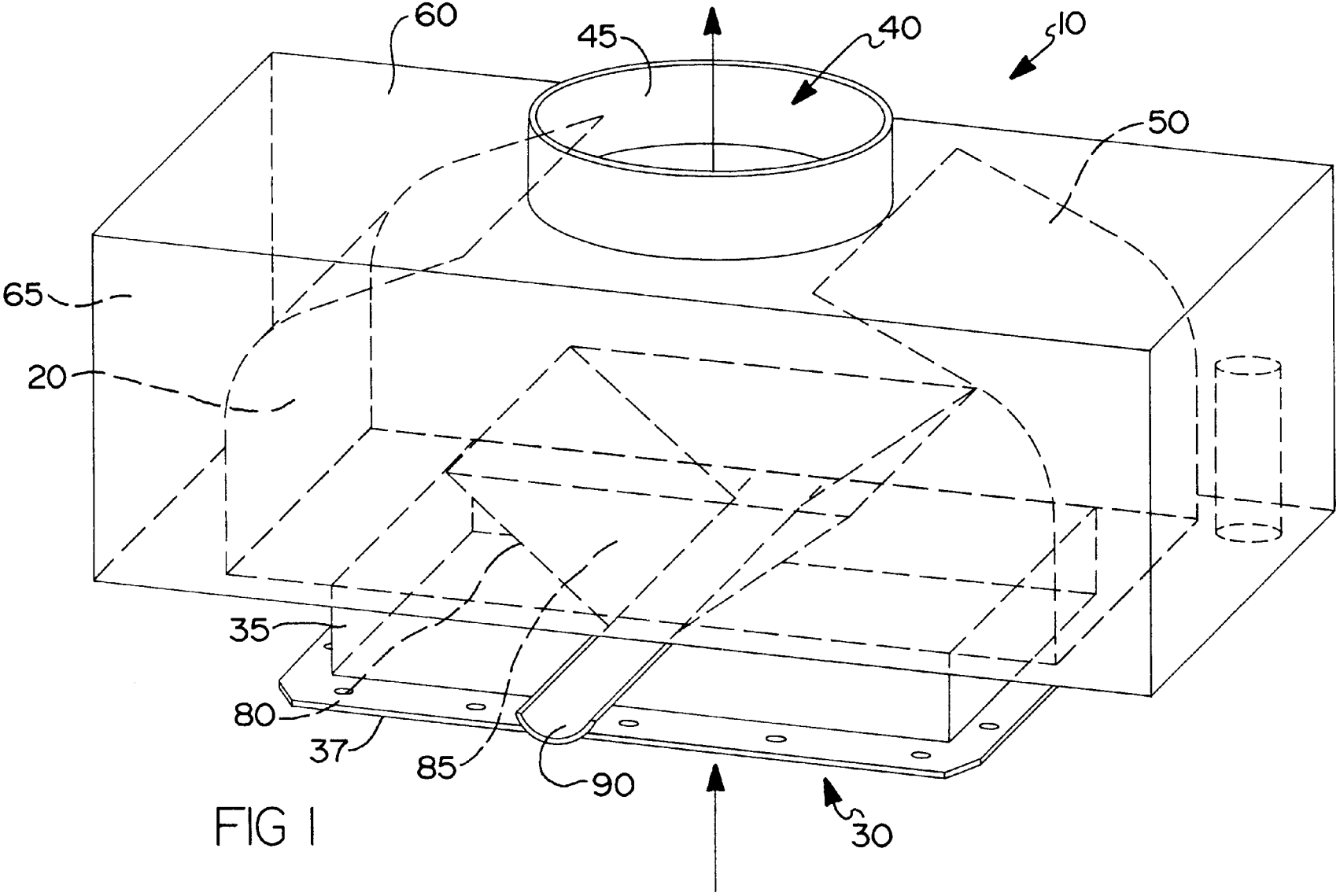
FIG. 1 is a perspective view of a silencer with an internal rain diverter.

Referring now to FIG. 1, one embodiment of the silencer 10 for reducing acoustic energy and diverting unwanted contaminants is shown. The silencer 10 comprises a chamber 20 which is at least partially defined by a chamber wall 50. The chamber 20 is in communication with an inlet port 30 for introducing exhaust gases from an exhaust stack (not shown). "Exhaust stack" as used herein shall include an exhaust port which provides exhaust gases from a combustion power source or any component thereof also exiting exhaust gases. An inlet collar 35 is in communication with inlet port 30 and provides for attachment to an exhaust stack leading from a combustion power source (not shown). A flange 37 extends from the inlet collar and provides a surface for fixedly attaching the silencer 10 to an exhaust stack.

An exhaust port 40 is in communication with chamber 20 to allow exhaust gases to exit the chamber 20. A housing 60 at least partially surrounds the chamber wall 50 to form at least one cavity 65. A deflector 80 is at least partially disposed within the chamber 20. The deflector has a gallery portion 85 which is in communication with a channel 90. At least one end of the channel 90 extends from the gallery portion 85 to provide a drain for the contents of the gallery portion 85.

A discussion of the operation of the silencer 10 of the present invention will now be made with reference to FIGS. 1 through 3. The arrows of FIG. 1 indicate the direction of flow for exhaust gases emitted from the combustion power source. The exhaust gases are introduced to the chamber 20 from the inlet port 30. The exhaust gas flow is redirected by the deflector 80 to allow the acoustic energy component of the exhaust gas to be attenuated. Referring specifically to FIG. 3, acoustic absorbing material 70, commonly known as "roving", is disposed within cavity 65. Although a single cavity 65 is shown in the present invention, it is contemplated that multiple cavities are within the spirit and scope of the present invention. Chamber wall 50 has a plurality of perforations to allow acoustic energy to flow through the chamber wall 50.

The flow path of the gas can be separated from the path of the acoustic energy. The separation is achieved by the deflector 80 which redirects the flow of exhaust gas to prevent the exhaust gas from flowing directly from the inlet port 30 to the exhaust port 40 which would result in little or no attenuation of acoustic energy. As can be seen in FIG. 3, the inlet port 30 is substantially vertically aligned with the exhaust port 40 as indicated by the vertical axis 25. Alignment of exhaust port 40 and inlet port 30 about the vertical axis 25 helps to achieve the goal of reduced backpressure. The exhaust gas will flow in the direction of least resistance.

The exhaust gas flow field is redirected by the deflector 80 and substantially follows the U-shaped contour of the chamber wall 50 and exits through exit port 40. However, acoustic energy does not follow the flow of the exhaust gas. The acoustic energy is deflected by the deflector 80 through perforations (not shown) in the chamber wall 50 and into the sound absorbing material 70. This sound absorbing material 70 receives the acoustic energy and reflects back a fraction of the energy which enters the cavity 65. Therefore, acoustic energy is absorbed without providing additional backpressure to the flow of exhaust gas from the combustion power source.

"Referring specifically now to FIG. 2, a top view of one embodiment of a silencer 10 of the present invention is shown. By eliminating a cap or weather hood from a silencer, the efficiency of a combustion power source can be improved. However, it is necessary to prevent rain and snow from entering the exhaust stack leading to a combustion power source. The deflector 80 is substantially V-shaped or had a substantial concave shape to allow rain and snow to be accumulated within the gallery portion 85. In the preferred embodiment, the deflector 80 is substantially centered about the vertical axis 25. The channel 90 may exit through the chamber wall 50, the housing 60 or the inlet collar 35 to facilitate drainage of galley portion 85."

It is contemplated within the spirit and scope of the present invention that any suitable substitute known in the art for a tube 95 may be utilized as the channel 90. The deflector 80 is substantially centered about the vertical axis 25 of the exhaust port 40 to optimize its rain diversion function. By providing deflector 80 substantially centered with the exhaust port 40 most rain or snow which enter the exhaust port 40 may be diverted from entering the exhaust stack. Therefore, the present invention provides a novel approach to attenuating acoustic energy while preventing rain or snow from entering an exhaust stack of a combustion power source with a minimal increase in backpressure.

The foregoing discussion discloses and describes the preferred embodiment of the present invention. However, one skilled in the art will readily recognize from such discussion and from the accompanying drawings and claims that various changes, modifications and variations can be made therein without departing from the true spirit and fair scope of the invention as defined in the following claims.

What is claimed is:

1. A silencer for reducing acoustic energy in a flow of exhaust gas from a combustion power source comprising:

a chamber at least partially defined by a chamber wall, said chamber in commnunication with an inlet port for introducing exhaust gas into said chamber and an exhaust port for exiting exhaust gas from said chamber, said inlet port adapted to be in communication with an exhaust stack;

a housing at least partially surrounding said chamber wall to form at least one cavity between said chamber wall and said housing, said cavity having acoustic absorbing material disposed therein; and a deflector at least partially disposed within said chamber, said deflector having a gallery portion in communication with a channel extending through said chamber wall, said channel for draining the contents of the gallery portion which are diverted from entering the exhaust stack.

2. The silencer as in claim 1, wherein said channel extends through said housing.

3. The silencer as in claim 1, further comprising an inlet collar in communication with said inlet port, said inlet collar adapted to be attached to an exhaust stack, wherein said channel extends through said inlet collar.

* * * * *